United States Patent [19]

Geberth, Jr.

[11] Patent Number: 4,728,213

[45] Date of Patent: Mar. 1, 1988

[54] POWER ROLLER ASSEMBLY

[76] Inventor: John D. Geberth, Jr., 10 Goose Cove Lane, Ramsey, N.J. 07446

[73] Assignee: Sanyo Electric Co., Ltd., Japan

[21] Appl. No.: 838,174

[22] Filed: Mar. 10, 1986

[51] Int. Cl.[4] ..... B05C 17/02; B05C 1/12

[52] U.S. Cl. ..... 401/197; 401/220

[58] Field of Search ..... 401/197, 175, 220

[56] References Cited

U.S. PATENT DOCUMENTS

| | | | |
|---|---|---|---|
| 2,498,980 | 2/1950 | Bowling, et al. | 401/197 X |
| 2,751,618 | 6/1956 | Pruitt | 401/197 |

FOREIGN PATENT DOCUMENTS

| | | | |
|---|---|---|---|
| 498680 | 2/1951 | Belgium | 401/197 |
| 1030227 | 5/1958 | Fed. Rep. of Germany | 401/197 |
| 2914030 | 10/1979 | Fed. Rep. of Germany | 401/197 |
| 420015 | 6/1911 | France | 401/175 |
| 623535 | 6/1981 | Switzerland | 401/175 |
| 829201 | 5/1981 | U.S.S.R. | 401/197 |

*Primary Examiner*—Steven A. Bratlie

*Attorney, Agent, or Firm*—Joseph J. Orlando

[57] ABSTRACT

A power roller assembly for painting or coating surfaces is provided having a roller applicator rotatably mounted on a roller applicator support arm through which paint under pressure is supplied to the interior of the roller applicator by means of a control valve communicating with a source of paint under pressure. The paint is distributed longitudinally along the interior of the roller applicator by means of a tubular-shaped manifold co-axially mounted and spaced from the roller applicator axle. The paint in the interior of the roller applicator is pushed longitudinally back and forth thereacross by means of an auger-like spiral mounted co-axially with the roller applicator for rotation therewith.

1 Claim, 4 Drawing Figures

POWER ROLLER ASSEMBLY

The present invention relates generally to paint rollers wherein the paint or other coating material is applied to and spread on a surface to be painted or coated by means of a roller applicator. More particularly, the present invention relates to a power roller assembly wherein paint under pressure is supplied to the interior of an absorbent roller so that the paint or other coating material is absorbed therethrough to the surface of the roller to be thereafter applied to the surface to be painted.

The use of paint rollers for the painting or application of other coating materials to surfaces such as walls has become widespread because of the ease with which the paint or coating material can thereby be applied. However, a drawback in the utilization of such paint rollers is the fact that it is necessary to apply the paint or coating material to the roller applicator surface at regular intervals. Generally, this is accomplished by rolling the roller applicator in a reservoir of paint and then wiping the excess from the roller before utilization of the roller on the surface to be painted. Such a procedure is very time consuming and thus detracts significantly from the commercial utilization of paint rollers by professional painters and painting contractors.

Power rollers were developed to overcome the problem associated with the time consuming application of paint to roller applicators. In the power roller, paint under pressure is supplied to the interior of the roller applicator which comprises an applicator surface of absorbent material which surrounds a cylindrically shaped, hollow support therefor having a large number of perforations throughout. The paint or other coating material passes through the perforations and is absorbed into the material of the roller applicator. Through the wicking action of the absorbent material the paint reaches the surface thereof. The use of such power rollers effectively eliminates the application of paint to the roller applicator by rolling the roller applicator in a reservoir of paint. A power roller assembly is generally constructed having a handle to one end of which is attached the roller support rod with the roller applicator rotatably mounted thereon and to the other end of which is attached a control valve. The control valve communicates by means of a flexible hose to a supply of pressurized paint. The pressurized paint is supplied through the control valve to the interior of the roller applicator by means of a conduit which may pass through the handle and support rod of the paint roller. Thus, a painter merely needs to periodically supply paint to the roller applicator by means of the control valve is that sufficient paint is present at the surface of the roller applicator during the painting operation.

However, in the operation of such a power roller, the paint which is supplied to the interior of the roller applicator tends to travel to the surface of the roller applicator at discrete peripheral locations. The paint supplied to the roller interior tends to form one or more discrete puddles therein and the areas of the applicator surface communicating with these puddles is thereby supplied with a greater amount of paint than other areas. Thus, there results heavy spots or unevenness in the painted surface which can only be overcome, if at all, by continued rolling by the painter.

It is, therefore, a primary object of the present invention to provide a power roller assembly for painting wherein the paint supplied to the interior of the roller applicator is distributed substantially evenly along the interior surface of the roller applicator so that the outer surface of the roller applicator is substantially evenly wetted with paint.

This object, as well as others which will hereinafter become apparent, is accomplished in accordance with the present invention by the provision of a power paint roller assembly wherein the paint or other coating material is supplied to the hollow, cylindrically shaped interior of the roller applicator by means of an axially arranged distribution manifold. The paint is thereafter substantially uniformly distributed along the interior surface of the roller applicator during the rolling operation by means of an auger-like spiral whose outer surface is substantially adjacent to the interior surface of the roller applicator and which extends throughout the length of the roller applicator. Thus, the auger-like spiral, which is adapted to rotate together with the roller applicator, physically moves the paint back and forth along the length of the interior of the roller applicator and thereby prevents the paint from forming puddles at any particular location within the roller. From the interior surface of the roller applicator, the paint passes through the perforations therein to be absorbed into the absorbent material of the roller applicator surface substantially uniformly along the length thereof.

Other objects and features of the present invention will become apparent from the following detailed description considered in connection with the accompanying drawings. It is to be understood, however, that the drawings are designed as an illustration only and not as a definition of the limits of the invention.

In the drawings wherein similar reference characters denote similar elements throughout the several views.

Figure 1:
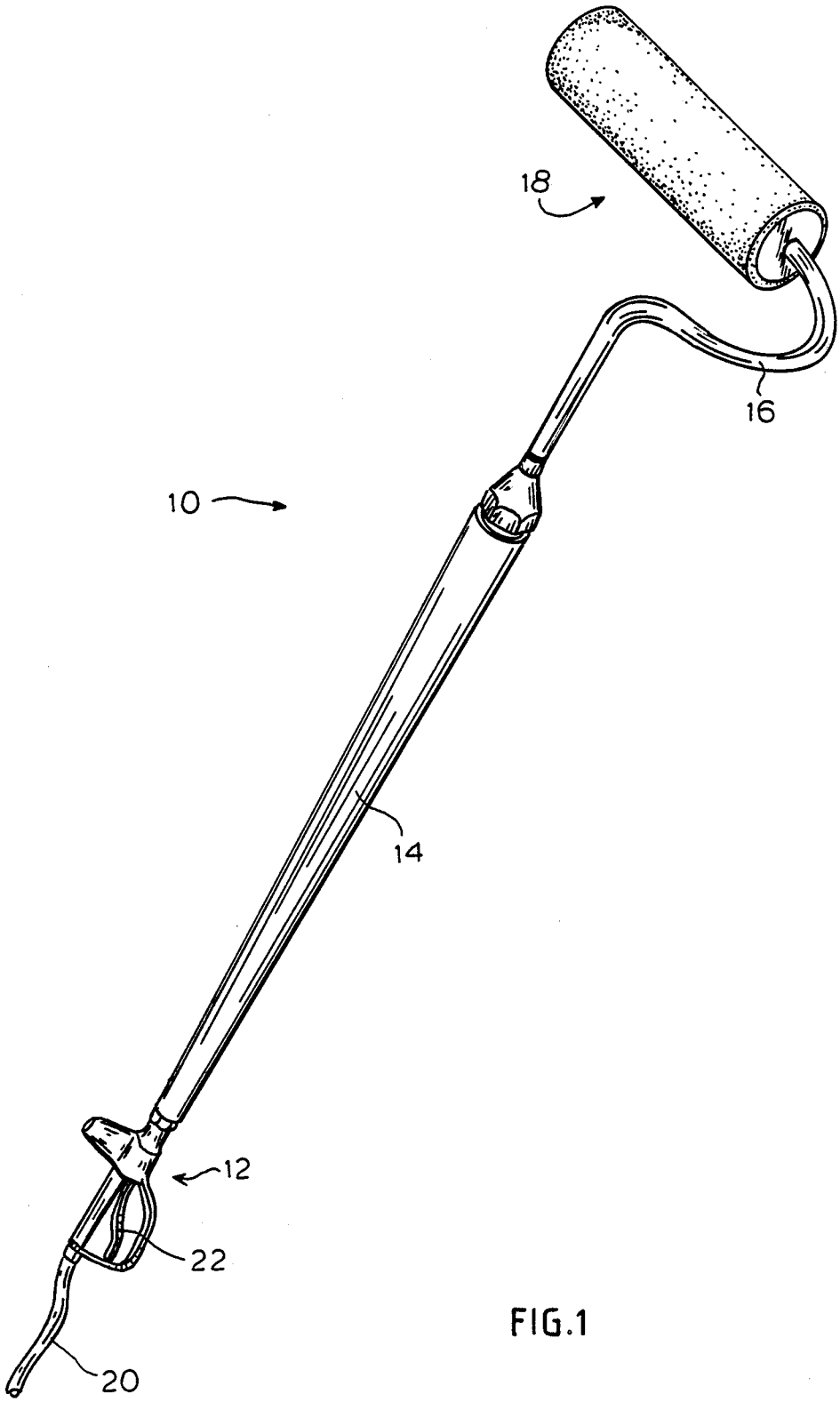
FIG. 1 is a perspective view of a power roller incorporating the present invention.

Now turning to the drawings, there is shown in FIG. 1 a power roller assembly, generally designated 10, comprised of a control valve 12, a handle portion 14, a support rod 16 and a roller applicator assembly 18. Control valve 12 communicates by means of flexible hose 20 to a supply of paint or other coating material (not shown) which is maintained under pressure. Control valve 12 is provided with a control means such as trigger 22 for releasing the paint supplied by hose 20 to the power roller applicator assembly 18.

Figure 3:
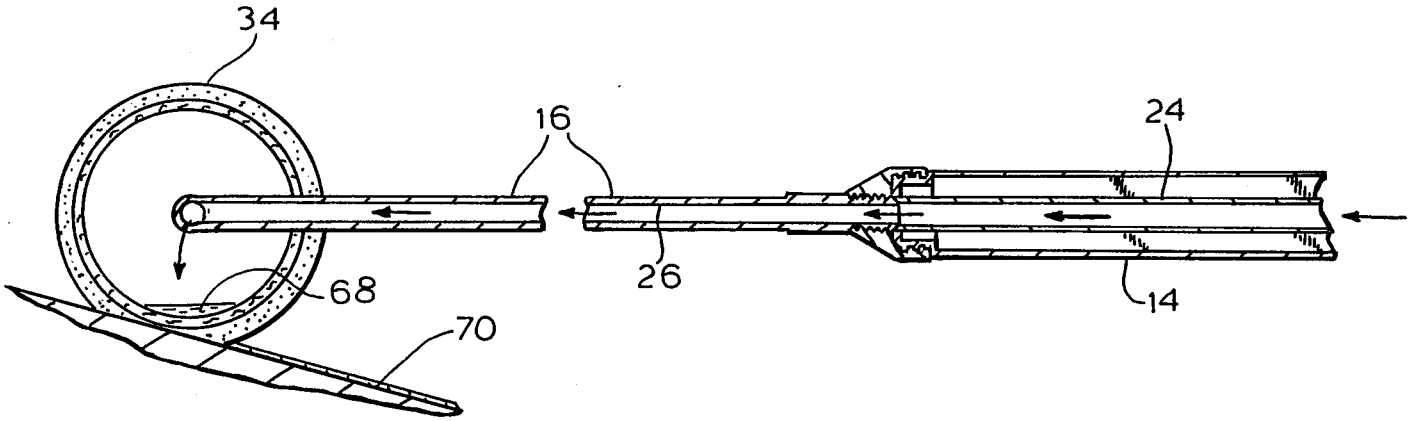
FIG. 3 is a lateral cross-sectional view of a portion of the power roller of FIG. 1 showing the roller applicator in use.

As clearly seen in FIG. 3, handle portion 14 may be provided with a conduit therein, designated 24 which communicates with the supply of paint from control valve 12 and supplies the same to support rod 16 which itself is provided with a fluid bore 26 to receive the paint.

Figure 2:
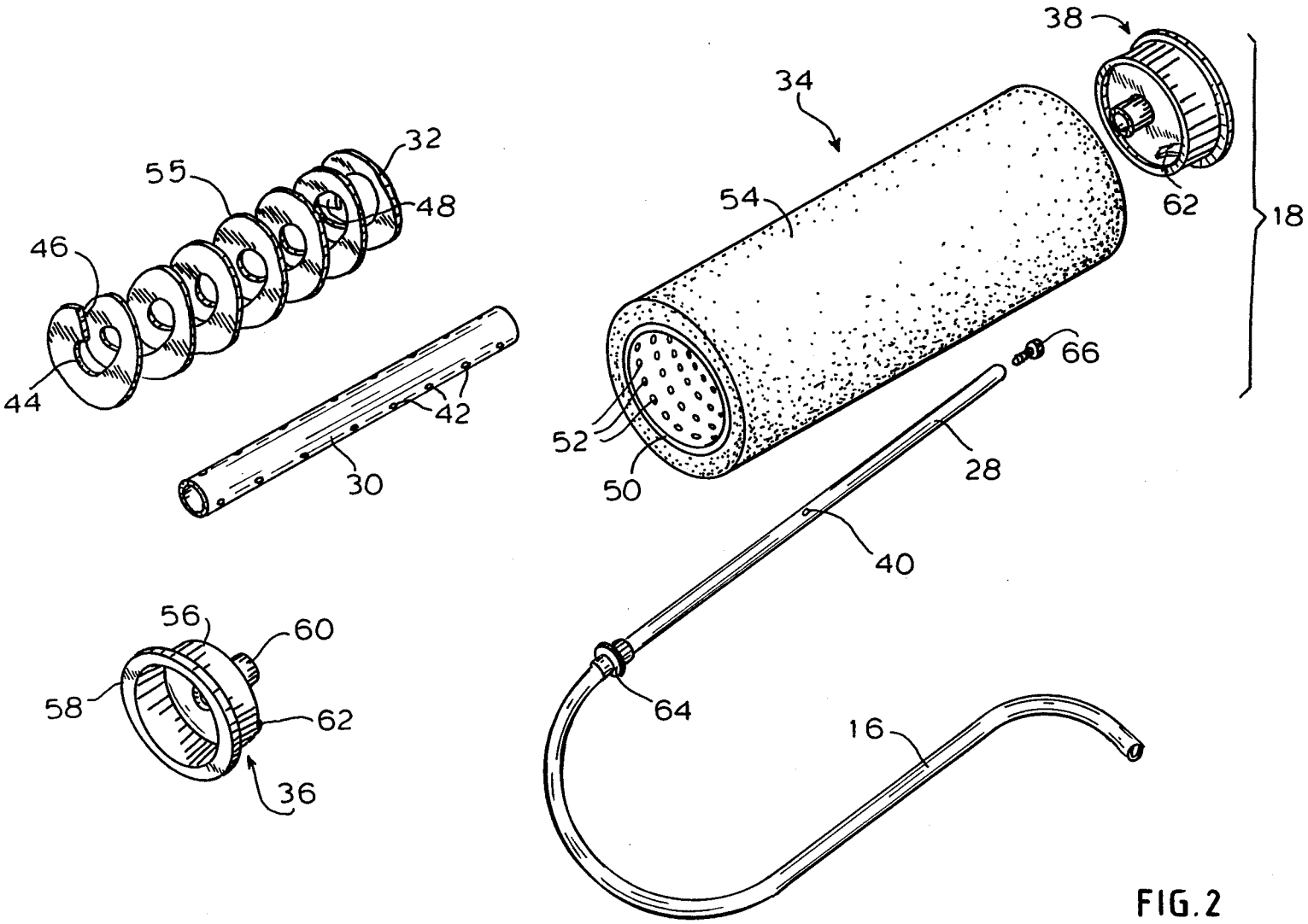
FIG. 2 is an exploded perspective view of the power roller applicator assembly according to the present invention and a portion of the handle therefor.

Roller applicator assembly 18, as clearly seen in FIG. 2, is rotatably mounted on roller applicator axle 28 which extends from support rod 16 substantially transversely to handle portion 14. Roller applicator assembly 18 comprises a paint supply manifold 30, an auger-like spiral 32, a roller applicator 34 and roller applicator end caps 36 and 38. Axle 28 is hollow or tubular in shape so that the interior thereof communicates with fluid bore 26 of support rod 16. Approximately centrally along the length of axle 28 there is provided an opening 40 through which the paint supplied by control valve 12 through handle portion 14 and support rod 16 passes. Paint supply manifold 30 is in the form of a cylindrically-shaped tube having a plurality of openings 42 distributed along the length thereof. Tubular-shaped manifold 30 is adapted to fit coaxially with axle 28 with a space therebetween. Auger-like spiral 32 is provided with an axial opening therein, designated 44, which is adapted to accept tubular-shaped manifold 30 therein. Auger-like spiral 32 is also provided with substantially radially directed flat ends 46 and 48 at the respective ends of the spiral.

Roller applicator 34 is comprised of a cylindrically-shaped support tube 50 having a multiplicity of openings in the surface thereof, designated 52. Supported on the outer surface of support tube 50, there is a material which forms roller applicator surface 54. The material which forms roller applicator surface 54 is an absorbent material adapted to pick up and hold paint therein and may be a porous, sponge-like material or a fibrous material suitable for painting or coating applications. Auger-like spiral 32 is so dimensioned that the outer edge or surface 55 thereof is substantially adjacent to the inner surface of support tube 50. Roller applicator end caps 36 and 38 are cup-shaped having cylindrical sidewalls 56 adapted to snugly fit into the open ends of support tube 50. At the outer rim of each end cap, there is provided a flange 58 which contacts the ends of roller applicator 34. Each end cap 36 and 38 is provided with a centrally disposed bushing 60 which is adapted to fit over roller applicator axle 28 and on which tubular-shaped paint supply manifold 30 is supported. Thus, tubular paint supply manifold 30 is radially spaced from axle 28 by the thickness of bushing 60. End caps 36 and 38 are also provided with inwardly projecting stops 62 which are adapted to engage with ends 46 and 48 of auger-like spiral 32 to thereby prevent its rotation relative to roller applicator 34.

Figure 4:
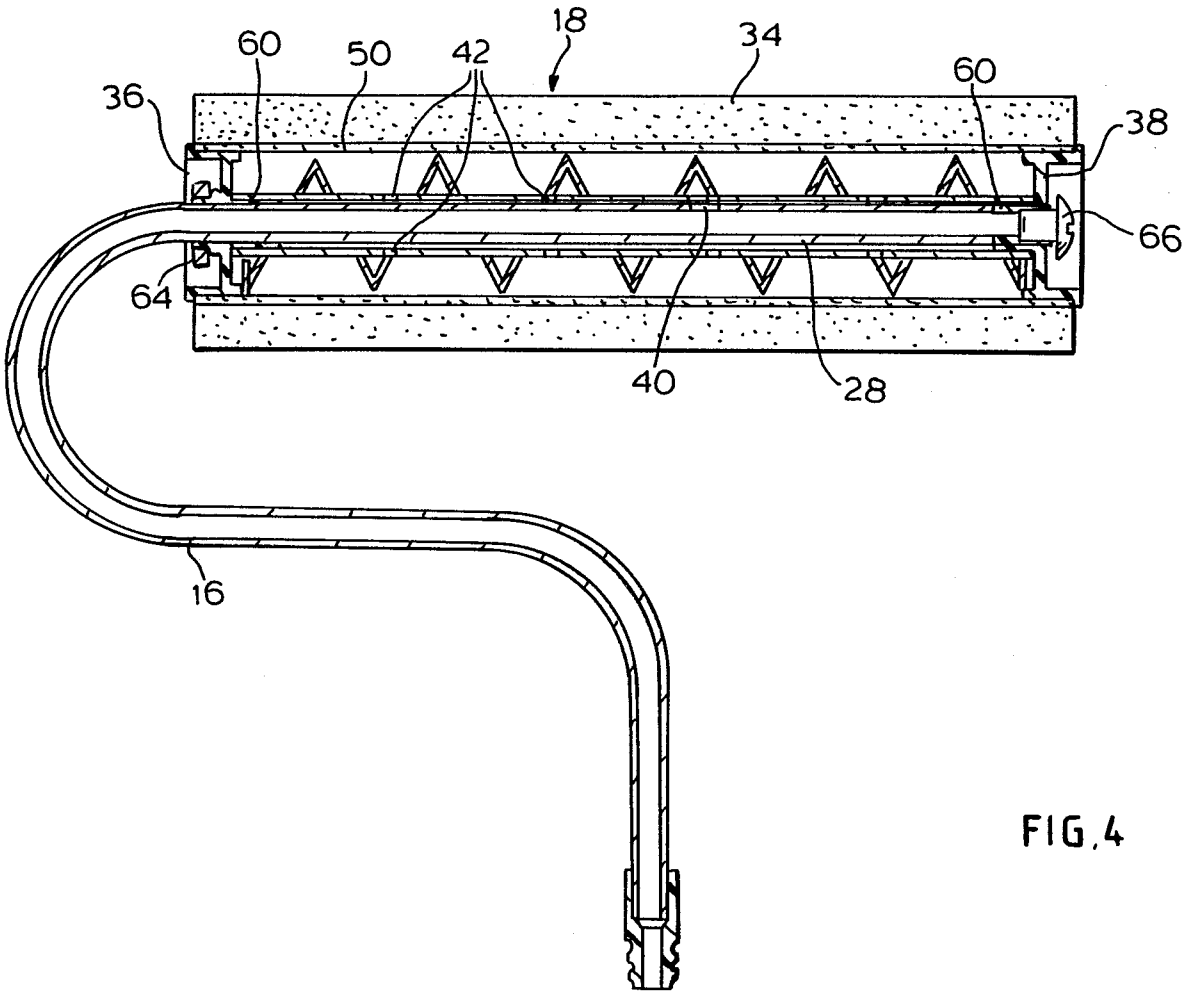
FIG. 4 is a longitudinal cross-sectional view of the power roller applicator assembly and a portion of the handle therefor.

As can be clearly seen in FIG. 4, roller applicator assembly 18 is mounted onto support rod 16 by inserting roller applicator axle 28 through bushings 60 of roller applicator end caps 36 and 38. Flanged bushing 64 on support rod 16 engages against roller end cap 36 while a securing device such as screw 66 is screwed into the free end of axle 28 and engages against roller end cap 38 to thereby compress the end caps against the ends of roller applicator 34.

In operation, paint under pressure is supplied to opening 40 of roller applicator axle 28, as shown by the arrows in FIG. 3, when the operator of the power roller activates trigger 22 of control valve 12. The paint exiting from opening 40 fills the space between axle 20 and the interior of tubular-shaped manifold 30 and exits from the plurality of openings 42 in manifold 30. Because of gravity, the paint from openings 42 tends to form a puddle, designated 68, in a localized area in the interior of support tube 50. However, as the roller applicator 34 is rolled on a surface 78 to be painted, auger-like spiral 32 rotates along with roller applicator 34 with the result that the puddle of paint is pushed first in one direction across the interior surface of support tube 50 and then, when the roller direction is reversed, the puddle 68 is pushed in the other longitudinal direction across the interior surface of support tube 50. Thus, the paint supplied to the interior of support tube 50 is evenly distributed across the interior surface thereof by the wiping action of the auger-like spiral 32. As the puddle of paint 38 is wiped across the interior surface of support tube 50, the paint passes through openings 52 therein to be absorbed through the material of roller applicator surface 54 so as to wet the surface thereof with paint. Since the distribution of the paint at the interior of support tube 50 is even, the werting of roller applicator surface 54 of roller applicator 34 is likewise even and, hence, the application of paint to the surface to be painted is also even.

While only a single embodiment of the present invention has been shown and described, it will be obvious that many changes and modifications may be made thereto without departing from the spirit and scope of the invention.

What is claimed is:

1. A power roller assembly comprising:

a control valve communicating with a source of coating material under pressure;

a handle to which said control valve is mounted and having extending therefrom a roller applicator support rod having a roller applicator axle;

a roller applicator assembly rotatably mounted to the roller applicator axle of said support rod and including a cylindrically shaped roller applicator having an absorbent roller applicator surface on a cylindrical support therefor and end caps having bushings therein for the rotatable mounting of said roller applicator assembly on said axle, said cylindrical support having a plurality of perforations in the cylindrical wall thereof permitting fluid communication between the interior of the roller applicator assembly and the absorbent roller applicator surface;

conduit means communicating between said control valve and the roller applicator axle of said support rod for delivering paint to the interior of the roller applicator assembly;

a paint supply manifold axially arranged in the interior of said roller applicator assembly consisting of a cylindrically shaped tube co-axially disposed on said roller applicator axle and axially spaced therefrom and having a plurality of paint supply openings arranged along the length thereof;

an auger-shaped spiral arranged along the length of the interior of said roller applicator assembly, said auger-shaped spiral having an axial opening therein permitting the disposition of said spiral on said paint supply manifold so that said spiral extends radially from said manifold to the inner surface of said cylindrical support; and an axially, inwardly extending stop disposed on each end cap adapted to engage an end of said auger-like spiral so as to prevent rotation thereof relative to said roller applicator assembly.

* * * * *

UNITED STATES PATENT AND TRADEMARK OFFICE

CERTIFICATE OF CORRECTION

PATENT NO. : 4,728,213

DATED : MARCH 1, 1988

INVENTOR(S) : JOHN D. GEBERTH, JR.

It is certified that error appears in the above-identified patent and that said Letters Patent are hereby corrected as shown below:

Cover page, item 73, should be deleted.

Signed and Sealed this

Twelfth Day of July, 1988

*Attest:*

*Attesting Officer*

DONALD J. QUIGG

*Commissioner of Patents and Trademarks*